US005620400A

United States Patent [19]

Foster

[11] Patent Number: 5,620,400

[45] Date of Patent: Apr. 15, 1997

[54] MOUNTAIN CLIMBING EXERCISE APPARATUS

[76] Inventor: Stephen R. Foster, 10865 Gold Hill Dr., Grass Valley, Calif. 95945

[21] Appl. No.: 693,347

[22] Filed: Aug. 6, 1996

[51] Int. Cl.[6] ..... A63B 23/04; A63B 21/00

[52] U.S. Cl. ..... 482/51; 482/52; 482/37

[58] Field of Search ..... 482/51, 52, 53, 482/57, 62, 148, 907, 95, 96, 37

[56] References Cited

U.S. PATENT DOCUMENTS

| | | | |
|---|---|---|---|
| 4,688,791 | 8/1987 | Long . | |
| 4,830,362 | 5/1989 | Bull | 482/53 |
| 4,989,858 | 2/1991 | Young et al. | 482/53 |
| 5,033,733 | 7/1991 | Findlay . | |
| 5,039,088 | 8/1991 | Shifferaw . | |
| 5,338,271 | 8/1994 | Wang . | |
| 5,378,209 | 1/1995 | Kendrew . | |
| 5,419,747 | 5/1995 | Piaget et al. | 482/51 |
| 5,518,470 | 5/1996 | Piaget et al. | 482/51 |

*Primary Examiner*—Stephen R. Crow

[57] ABSTRACT

Exercising apparatus of a type generally simulating a walking or crawling motion. The apparatus has a vertical support mast, right hand and left hand operated levers journaled to the mast, and left and right foot treadles journaled to the mast. The right hand operated lever is connected to the right foot treadle by one connecting rod, and the left hand operated lever is connected to the left foot treadle by a second connecting rod. The connecting rods cause their corresponding hand and foot to approach one another then diverge in repeating cycles. A link rod connects the right foot treadle to the left hand operated lever. Right and left treadles and levers therefore undergo similar motions, but are offset from one another by half a cycle. For example, the right hand and foot converge while the left hand and foot diverge.

8 Claims, 2 Drawing Sheets

MOUNTAIN CLIMBING EXERCISE APPARATUS

BACKGROUND OF THE INVENTION

1. Field of the Invention

The present invention relates to apparatus for exercising. More particularly, the apparatus is intended for simulating the motions most likely to be frequently employed in mountain climbing. A handhold for the right hand and a foothold for the right foot are mutually interconnected to move together, with the handhold descending while the foothold ascends. A second handhold and a second foothold are similarly linked to move together in a similar motion. The left side members duplicate the motions of the right side members, but are displaced by half a cycle.

2. Description of the Prior Art

Physical conditioning for any given endeavor can be significantly improved by exercising the involved muscles and also by increasing general cardiovascular condition. Many sports have enjoyed the benefit of exercising equipment designed to exercise arm and leg muscles by opposed, cyclic effort. In U.S. Pat. No. 5,378,209, issued to Robert J. Kendrew on Jan. 3, 1995, there is described an exercising device which causes each arm and its corresponding leg to move together, but in opposite directions. An interconnection between right and left components enables the right side components to act oppositely the left side components. However, unlike the present invention, the Kendrew device relies upon a system of cables and pulleys to distribute forces among the various treadles and hand operated levers.

In U.S. Pat. No. 5,039,088, issued to Tessema D. Shifferaw on Aug. 13, 1991, an exercise machine is shown which combines a pulley and cable arrangement with rigid connecting rods to distribute forces among the treadles and hand operated levers. By contrast, the present invention employs only rigid connecting rods to distribute forces. A second difference is that position of the user varies significantly from that of the instant invention in a way rendering the exercise to be less than suitable for mountain climbing exercises. Shifferaw's device has a seat, unlike the present invention.

An example of an exerciser dedicated to mountain climbing and running motions is seen in U.S. Pat. No. 5,338,271, issued to Leao Wang on Aug. 16, 1994. This exerciser has two treadles and handles which are mutually connected by a system of cables and pulleys. By contrast, the present invention employs rigid rods for transferring forces among the moving members. Also, the hand gripped elements in the Wang device do not move vertically oppositely from the treadles, as occurs in the present invention.

None of the above inventions and patents, taken either singly or in combination, is seen to describe the instant invention as claimed.

SUMMARY OF THE INVENTION

The present invention provides motions which are particularly suitable for mountain climbing activities. These motions require that on one lateral side of the user, the hand and foot cyclically approach one another and diverge. On the other lateral side, the same motions are achieved, but are displaced by half a cycle, such that they are opposite those of the first lateral side. The body remains with the torso generally vertical.

All resistance is provided by the user's weight and effort. This result is achieved by connecting two foot treadles and two hand operated levers by only three rigid interconnecting rods. One rod connects the right foot treadle to the right hand operated lever so that as the foot treadle ascends, the right hand operated lever descends. A second rod connects the left foot treadle to the left foot operated lever, to similar effect. The third rod connects the right side foot treadle to the left hand operated lever, so that operating cycles are displaced by half a cycle. In other words, while the right side foot treadle and the right hand operated lever approach one another, their left side counterparts diverge.

The hand operated levers have outwardly projecting hand grips, so that the hand levers may be located close to the mast for compactness, and to further simulate a mountain climbing stance. All components are supported on a vertical mast having a base for stable support on a floor or other horizontal environmental surface.

Accordingly, it is a principal object of the invention to provide an exercise machine capable of producing motions suitable for mountain climbing activities.

It is another object of the invention to interconnect foot treadles and hand operated levers only by rigid connecting rods.

It is a further object of the invention to maintain the user's torso vertical during use.

Still another object of the invention is to cause the right and left sides of the body to move oppositely.

An additional object of the invention is to cause the arm and leg of one side of the user's body to alternately approach one another, then diverge, in repeating cycles.

It is again an object of the invention to provide outwardly turned handles on the hand operated levers.

Yet another object of the invention is to provide a base for supporting the novel exercise device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
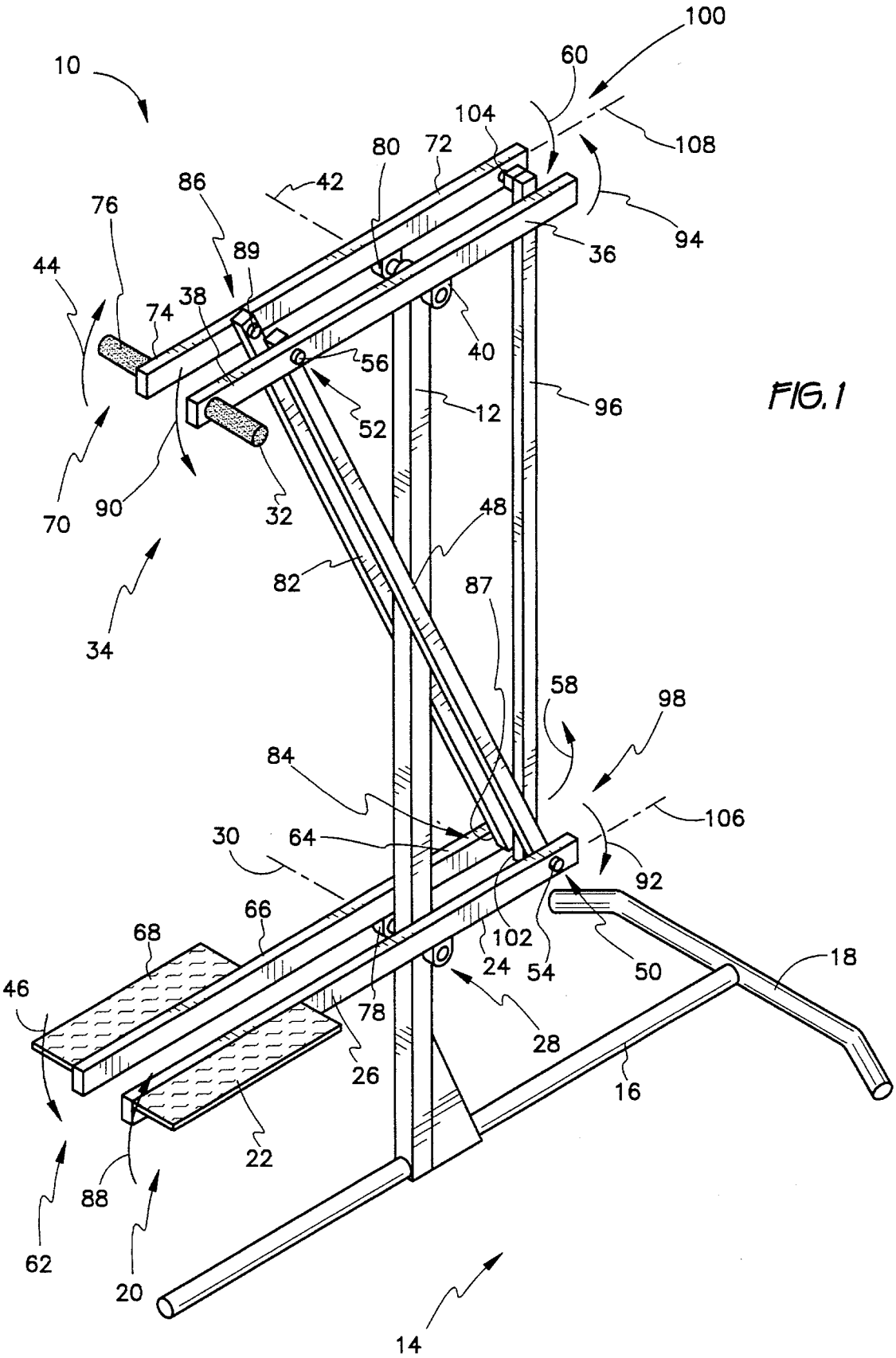
FIG. 1 is a perspective view of the invention.

Exercising apparatus 10 is seen in FIG. 1 to comprise stationary components including a vertical mast 12 having a base 14 formed from intersecting rods 16, 18. Base 14 supports apparatus 10 on any solid, stable horizontal surface (not shown). Moving components include a right side foot treadle 20 having a plate 22 bearing treads for footing traction, a forward section 24 projecting forwardly of mast 12, and a rear section 26 projecting rearwardly of mast 12. A bearing assembly 28 is fixed to mast 12, rotatably supporting or journaling right side foot treadle 20 at mast 12. Axis 30 of pivot of the journaled portion of bearing 28 is horizontal.

A user (not shown) places his or her right foot on plate 22, and grasps hand grip 32 of right hand operated lever 34 with his or her right hand. Lever 34 has a forward section 36 and a rear section 38, these directions being determined relative to mast 12. Another bearing assembly 40 rotatably supports or journals lever 34 at mast 12. Axis 42 of pivot is horizontal.

Right side treadle 20 and right hand operated lever 34 operate in concert, but incline in opposite directions, as indicated by arrows 44, 46. Oppositely directed inclination is achieved by provision of a right side connecting rod 48 having proximal and distal ends 50, 52 (respectively). Rod 48 is rotatably fixed to right foot treadle 20 at a bearing 54 secured to proximal end 50 and is rotatably fixed to right hand operated lever 34 at a bearing 56 at distal end 52.

It will be seen that connecting rod 48 attaches to forward section 24 of foot treadle 20 and to rear section 38 of right hand operated lever 34. Because foot treadle 20 and right hand operated lever 34 are pivotally journaled to mast 12 at a point intermediate the points of anchorage of connecting rod 48, it follows that when forward section 24 of foot treadle 20 rises, or inclines in the direction indicated by arrow 58, forward section 36 of right hand operated lever 34 will move oppositely, as indicated by arrow 60.

Right side foot treadle 20 and right hand operated lever 34 have left side counterparts which are constructed essentially in mirror image. These components include left side foot treadle 62 having forward section 64, rear section 66, and foot plate 68, and left hand operated lever 70. Lever 70 has a forward section 72, a rear section 74, and a hand grip 76.

Left side foot treadle 70 has a bearing assembly 78 similar to bearing assembly 28, and bearing assemblies 28, 78 share common axis 30 of pivot. Similarly, left hand operated lever 70 has a bearing assembly 80 similar to bearing assembly 40, for journaling lever 70 at mast 12. Bearing assemblies 40, 80 share common axis 42 of pivot.

To maintain analogous function, left side foot treadle 62 and left hand operated lever 70 are connected by connecting rod 82, which is generally similar in nature to but a mirror image of rod 48. Rod 82 has proximal and distal ends 84, 86, at which points it is rotatably fixed at bearing 87 to forward section 64 of left side foot treadle 62 and to rear section 74 of left hand operated lever 70 (respectively) by bearing 89.

Right side foot treadle 20 and associated right side lever 34 always operate oppositely their mirror image left side counterparts. This is underscored by arrow 88, which is oppositely directed relative to arrow 46. Similarly, arrow 90 is oppositely directed relative to arrow 44. Arrows 58 and 60 also have oppositely directed counterparts in arrows 92 and 94.

The right and left sides are mechanically linked such that their cycles of operation are offset by half a cycle by an offsetting link 96 having proximal and distal ends 98, 100. Link 96 is rotatably connected at proximal end 98 by a bearing 102 to right side foot treadle 20, and at distal end 100 by bearing 104 to left hand operated lever 70.

Unlike all other journaling bearings, bearings 102 and 104 have axes 106, 108 (respectively) which are oriented parallel to rod 16 of base 14, as depicted in FIG. 1. All other axes of pivot of the remaining bearings are arranged parallel to rod 18, as depicted. Orientation of axes 106, 108 need not be parallel to a member of the base, this being coincidentally inherent in the embodiment illustrated herein. This relationship is set forth only for purposes of explaining that of the moving parts, only link 96 moves through a plane which is not parallel to those occupied by the remaining significant moving parts.

Hand grips 32 both project outwardly, albeit in opposed direction, relative to mast 12. This characteristic enables hand operated levers 34 and 70 to be located close to mast 12 for compactness, while still enabling a user position simulating that employed to scale a sheer face of a mountain.

Figure 2:
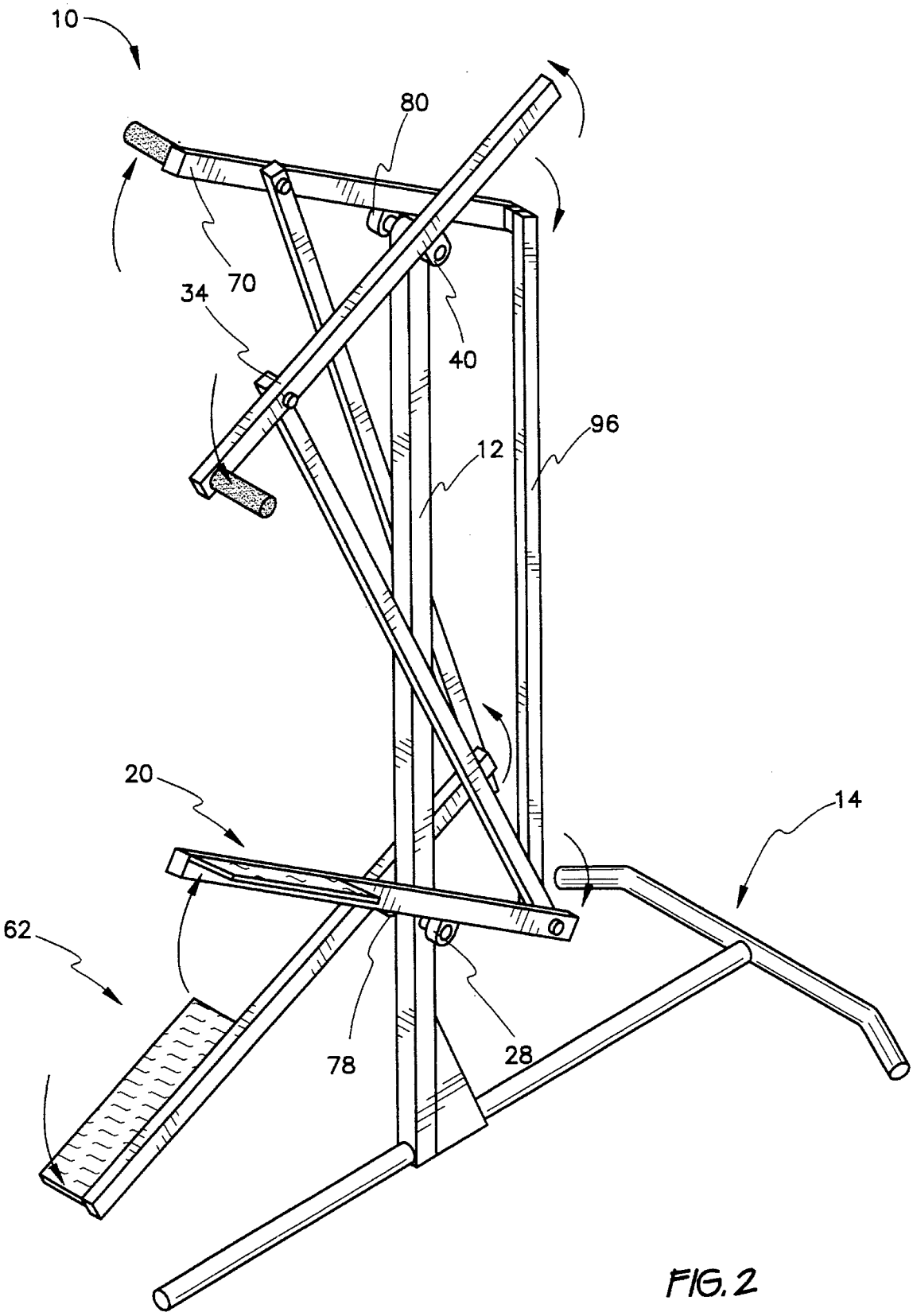
FIG. 2 is a perspective view of the invention, with oscillating components shown substantially at the limits of their travel.

FIG. 2 illustrates foot treadles 20, 62, hand operated levers 34, 70, and associated linkage rods moved from the positions depicted in FIG. 1. FIG. 2 better depicts the motion of apparatus 10 when being used. It will be appreciated that in the absence of springs, weights, and powered resistance elements, all loads stem from the effort of the user as he or she overcomes his or her own weight and inertia.

A user may place his or her feet either in a forward or rearward position on foot plates 22 and 68. This provides easy accommodation of persons of different heights. Shorter people will tend to position themselves forwardly on foot plates 22, 68, positioning themselves appropriately relative to the fulcrum provided by bearings 28, 78.

It will occur to those of skill in the art that variations and modifications may be made to the invention without departing from the spirit thereof. Illustratively, construction of the apparatus need not be symmetrical, as shown. For example, one connecting rod 48 or 82 may be reversed in its anchorage at its associated foot treadle 20 or 62 and at its associated hand operated lever 34 or 70. Symmetry is preferred in order to maximize stability, for the purpose of minimizing size of base 14. Also, bearings 28 and 78 need not be coaxial, nor must bearings 40 and 80 be coaxial.

It will also be appreciated that link 96 may alternatively connect left side foot treadle 62 to right hand operated lever 34. Similarly, connecting rods 48 and 82 may attach to forward sections 36, 72 of their respective hand operated levers 34, 70 at their distal ends, with proximal ends attached to rear sections 26, 66 of the respective foot treadles 20, 62.

Bearings, where shown, enable secure, rotatable connection of two elements. Bearings may comprise a member having a bore for rotatably receiving, supporting and retaining a shaft. Bearings may have ball or roller elements if desired, or take still other embodiments.

Base 14 may assume other forms. For example, it may include downwardly directed prongs (not shown), for penetrating the ground, or for penetrating sockets (not shown) supported in the ground, in a floor, or in another supporting frame or structure (not shown).

It will further be obvious that features such as adjustability of hand operated levers 34, 70 may be introduced. Also, apparatus 10 may be assembled in a manner enabling ready disassembly, for compactness of storage.

It is to be understood that the present invention is not limited to the embodiments described above, but encompasses any and all embodiments within the scope of the following claims.

I claim:

1. Exercising apparatus requiring body motions which are particularly suitable for mountain climbing activities, said exercising apparatus comprising:

a vertical mast;

a right foot treadle and first bearing means for journaling said right foot treadle at said mast, said first bearing means having a horizontal axis of pivot, said right foot treadle having a forward section projecting forwardly of said mast and a rear section projecting rearwardly of said mast, and a left foot treadle and second bearing means for journaling said left foot treadle at said mast, said second bearing means having a horizontal axis of pivot, said left foot treadle having a forward section projecting forwardly of said mast and a rear section projecting rearwardly of said mast;

a right hand operated lever and third bearing means for journaling said right hand operated lever at said mast, said third bearing means having a horizontal axis of pivot, said right hand operated lever having a forward section projecting forwardly of said mast and a rear section projecting rearwardly of said mast, and a left hand operated lever and fourth bearing means for journaling said left hand operated lever at said mast, said fourth bearing means having a horizontal axis of pivot, said left hand operated lever having a forward section projecting forwardly of said mast and a rear section projecting rearwardly of said mast;

a right side connecting rod having proximal and distal ends, said right side connecting rod rotatably fixed to said right foot treadle at said proximal end and rotatably fixed to said right hand operated lever at said distal end, said proximal end fastened to one of said forward section of said right foot treadle and said rear section of said right foot treadle, and said distal end fastened to the other of said forward section of said right hand operated lever and said rear section of said right hand operated lever;

a left side connecting rod having proximal and distal ends, said right side connecting rod rotatably fixed to said left foot treadle at said proximal end and rotatably fixed to said left hand operated lever at said distal end, said proximal end fastened to one of said forward section of said left foot treadle and said rear section of said left hand operated lever, and said distal end fastened to the other of said forward section of said left hand operated lever and said rear section of said left foot treadle; and an offsetting link having a proximal end and a distal end, said proximal end rotatably connected to said right foot treadle and said distal end rotatably connected to said left hand operated lever.

2. The exercising apparatus according to claim 1, further comprising a base for supporting said exercising apparatus on a horizontal surface.

3. The exercising apparatus according to claim 1, said right hand operated lever having an outwardly projecting hand grip and said left hand operated lever having an outwardly projecting hand grip.

4. The exercising apparatus according to claim 1, said offsetting link connected to said right foot treadle and to said left hand operated lever forwardly of said mast.

5. Exercising apparatus requiring body motions which are particularly suitable for mountain climbing activities, said exercising apparatus comprising:

a vertical mast;

a right foot treadle and first bearing means for journaling said right foot treadle at said mast, said first bearing means having a horizontal axis of pivot, said right foot treadle having a forward section projecting forwardly of said mast and a rear section projecting rearwardly of said mast, and a left foot treadle and second bearing means for journaling said left foot treadle at said mast, said second bearing means having a horizontal axis of pivot, said left foot treadle having a forward section projecting forwardly of said mast and a rear section projecting rearwardly of said mast;

a right hand operated lever and third bearing means for journaling said right hand operated lever at said mast, said third bearing means having a horizontal axis of pivot, said right hand operated lever having a forward section projecting forwardly of said mast and a rear section projecting rearwardly of said mast, and a left hand operated lever and fourth bearing means for journaling said left hand operated lever at said mast, said fourth bearing means having a horizontal axis of pivot, said left hand operated lever having a forward section projecting forwardly of said mast and a rear section projecting rearwardly of said mast;

a right side connecting rod having proximal and distal ends, said right side connecting rod rotatably fixed to said right foot treadle at said proximal end and rotatably fixed to said right hand operated lever at said distal end, said proximal end fastened to one of said forward section of said right foot treadle and said rear section of said right foot treadle, and said distal end fastened to the other of said forward section of said right hand operated lever and said rear section of said right hand operated lever;

a left side connecting rod having proximal and distal ends, said right side connecting rod rotatably fixed to said left foot treadle at said proximal end and rotatably fixed to said left hand operated lever at said distal end, said proximal end fastened to one of said forward section of said left foot treadle and said rear section of said left foot treadle, and said distal end fastened to the other of said forward section of said left hand operated lever and said rear section of said left hand operated lever; and an offsetting link having a proximal end and a distal end, said proximal end rotatably connected to said left foot treadle and said distal end rotatably connected to said right hand operated lever.

6. The exercising apparatus according to claim 5, further comprising a base for supporting said exercising apparatus on a horizontal surface.

7. The exercising apparatus according to claim 5, said right hand operated lever having an outwardly projecting hand grip and said left hand operated lever having an outwardly projecting hand grip.

8. The exercising apparatus according to claim 5, said offsetting link connected to said left foot treadle and to said right hand operated lever forwardly of said mast.

* * * * *